US005367847A

United States Patent [19]

Hepler

[11] Patent Number: 5,367,847

[45] Date of Patent: Nov. 29, 1994

[54] COMPOSITE BUILDING STRUCTURE AND METHOD FOR CONSTRUCTING SAME

[75] Inventor: Eric J. Hepler, Pottstown, Pa.

[73] Assignee: Anthony Industries, Inc., Adrian, Mich.

[21] Appl. No.: 939,169

[22] Filed: Sep. 2, 1992

[51] Int. Cl.[5] ..... E04C 1/00

[52] U.S. Cl. ..... 52/309.4; 52/309.2; 52/309.12; 52/410; 428/319.9; 428/99; 428/247

[58] Field of Search ..... 52/309.2, 309.4, 309.5, 52/309.8, 309.9, 309.12, 363, 405.1, 410, 411; 428/99, 102, 120, 391.7, 391.9, 247

[56] References Cited

U.S. PATENT DOCUMENTS

| | | | |
|---|---|---|---|
| 3,492,196 | 1/1970 | Moore | 52/309.12 |
| 3,871,147 | 3/1975 | Stegmeier | 52/309.12 |
| 4,333,290 | 6/1982 | Koberstein | 52/309.2 |
| 4,334,394 | 6/1982 | Mader | 52/309.12 |
| 4,564,554 | 1/1986 | Mikuski | 428/311.9 |
| 4,578,915 | 4/1986 | Schneller et al. | 52/309.12 |
| 4,646,498 | 3/1987 | Schneller et al. | 52/309.12 |
| 4,653,246 | 3/1987 | Hepler | 52/309.2 |
| 4,866,897 | 9/1989 | Yount | 52/363 |
| 4,947,600 | 8/1990 | Porter | 52/309.12 |

FOREIGN PATENT DOCUMENTS 0195314 9/1986 European Pat. Off. ..... 52/309.12

*Primary Examiner*—Carl D. Friedman
*Assistant Examiner*—Winnie Yip
*Attorney, Agent, or Firm*—Marshall & Melhorn

[57] ABSTRACT

A laminated construction board comprising a kraft board support backing adhesively bonded to a foam insulating panel is disclosed. Also shown is an improved method for attaching laminated construction boards with fasteners. The fasteners are driven through the foam panel, until the retaining portion thereof engages the support backing, securing it in abutting relationship with an underlying wall substructure. The insulated surface of the board may be covered with various surface finishes, and is especially suited for use with acrylic mortar systems. Also disclosed is a building structure, a method of constructing a building structure, a wall surfacing system, and a method of constructing a wall sheathing, all utilizing construction boards attached to a substructure with staples wherein the crown of the staple engages the support backing of the construction board.

11 Claims, 5 Drawing Sheets

COMPOSITE BUILDING STRUCTURE AND METHOD FOR CONSTRUCTING SAME

BACKGROUND OF THE INVENTION

1. Field of the Invention

This invention relates generally to a composite building structure and a method of constructing the same. It further relates to a thermally insulating laminated construction board, a method of construction utilizing the construction board, and a method of applying a surface treatment to the construction board.

2. Description of the Prior Art

For a number of years the building industry has employed many types of foam panels to provide thermal insulation and to serve as backing for various facing materials such as stucco or other surface finishing material. Typically these foam panels have been installed by cementing them, or mechanically fastening them, to an underlying substrate. This has proven generally satisfactory, but does require extra time and labor to install an underlying substrate, and then affix a separate layer of insulating foam panels. Also, the foam panels alone do not have sufficient tensile strength, and an underlying substrate is required in order to achieve a structural rating under building codes, where required.

The use of a composite sheathing material comprising a support backing bonded to an insulating foam layer, such as described in U.S. Pat. No. 4,564,554, is an advance in the art, in that the support back and foam layer arrive at the building site already bonded together, eliminating the need to separately attach the layers. However, ordinary installation methods are inadequate if a structural rating is required since the restraining means of the fasteners used (e.g., the head of a nail, or the crown of a staple) engage the outer surface of the foam insulation, which has insufficient resistance to compression to hold the panel securely against an underlying wall substructure.

Additionally, whether or not a structural rating is required, unless special and relatively expensive fastening means are used, surface finishing material layered over these fasteners is subject to "nail pops" (fractures of the layer due to uneven support over a fastener), and "rust through" (staining of the layer due to the rusting of the underlying fastener). While cementing of the panels to the underlying wall substructure avoids these problems, the use of an adhesive cement can be more expensive, and results in delays to allow adequate drying of the cement. Further, the temperature range in which these adhesives can be applied is restricted.

My U.S. Pat. No. 4,653,246 discloses an additional advance in the art. In one embodiment, it discloses a composite insulation board having a plurality of spaced transversely extending holes for the reception of fasteners for attaching the board to a building wall. Disposed coaxially within each hole is a flanged sleeve through which fasteners, such as screws, nails, or the like are driven, engaging the underlying wall structure and securing the board in tight abutting relation to the surface of the underlying wall structure. The fasteners are provided with heads which engage the flanged ends of the hollow sleeves. Plugs of insulating material are inserted to fill the holes after the fasteners have been installed, covering the ends of the fasteners and avoiding the problems of fasteners which engage the outer surface of a construction panel.

This system is generally satisfactory. However, there are a finite number of fastening locations provided on such a panel. If the underlying structure has a void beneath one of the fastening locations of the panels, the panel cannot be fastened in that location. Furthermore, securing the plugs in the holes is an additional labor step. Plugs of insulating material are inserted to fill the holes after the fasteners have been installed, covering the ends of the fasteners and avoiding the problems of fasteners which engage the outer surface of a construction panel.

Other fastening systems, such as the FINESTONE EIS Mechanical Fastening System, sold by Applicant's Assignee, have been developed which are not limited as to the positioning of the holes, but this is still a rather labor-intensive system when compared with the present invention.

Thus, those skilled in the art continue to look for solutions to the problem of providing an inexpensive, insulated, laminated construction board and methods for easily, quickly, and securely installing and finishing construction boards.

SUMMARY OF THE INVENTION

In accordance with the present invention, there is provided a laminated construction board comprising a support backing adhesively bonded to a foam insulating panel, and a method for attaching laminated construction boards with staples or other fasteners. It should be understood that the term "support backing" should be interpreted broadly to include any practical material, such as virgin kraft board, recycled paper or "chip" board, or a combination of these. In addition, Masonite® can be used. Any practical support backing can be used and be within the scope of the present invention. The fasteners are driven through the foam panel until the restraining portion of the fastener engages the support backing, securing it in abutting relationship with an underlying wall substructure. The insulated surface of the construction board may be covered with various surface finishes. In this manner, not only do the construction boards arrive at the construction site with the foam and the support backing already laminated together, but an economical method of installation is provided.

Thus, it is an object of the present invention to provide a quick and efficient method of attaching laminated construction boards.

It is a further object of this invention to provide an inexpensive laminated construction board.

It is another object of this invention to provide a method of attaching laminated construction boards of sufficient structural strength and integrity such that a structural rating may be obtained if desired.

Still another object of the present invention is to provide an improved insulated building and a method of constructing the same.

It is another object of the present invention to provide an improved wall finishing system which may be quickly and easily installed.

BRIEF DESCRIPTION OF THE DRAWINGS

The above, as well as other advantages of the present invention, will become readily apparent to those skilled in the art from the following detailed description of the preferred embodiments when considered in the light of the accompanying drawings in which.

DESCRIPTION OF THE PREFERRED EMBODIMENT

Figure 1:
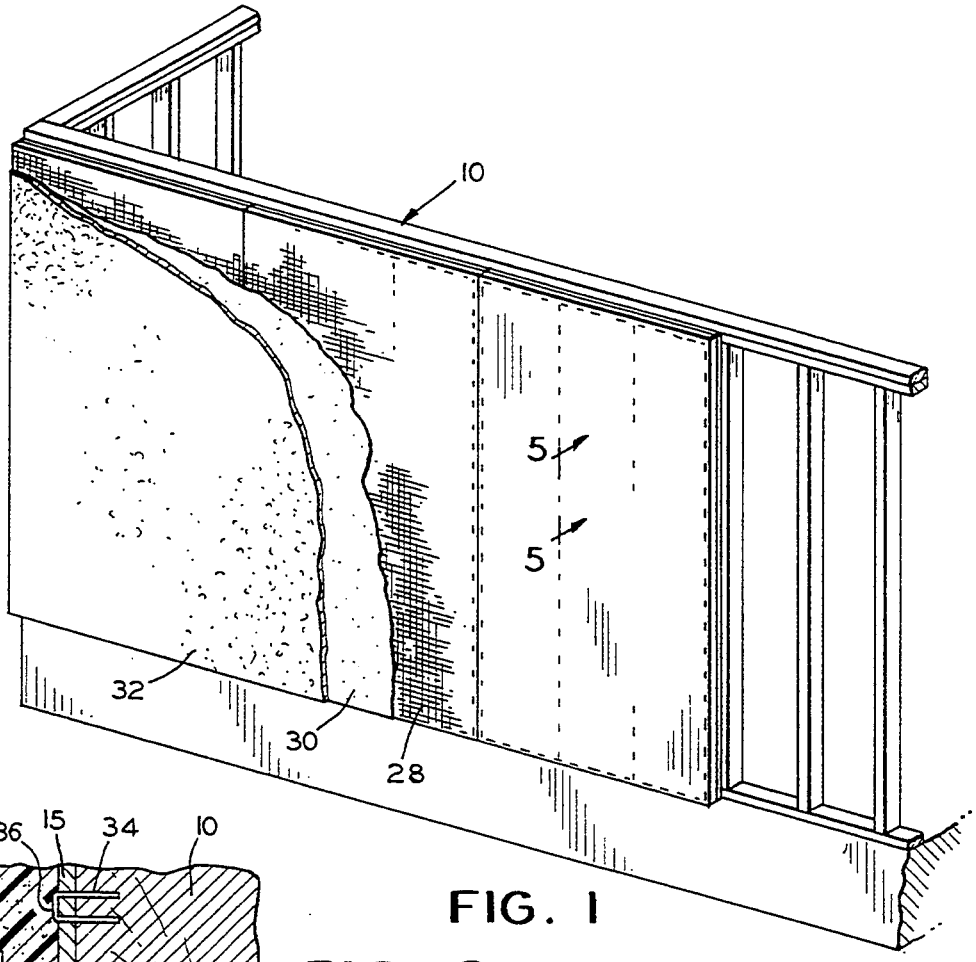
FIG. 1 is a perspective view of a building structure constructed in accordance with the present invention, with partial cutaways of one wall illustrating the various layers of the composite structure.

Referring to FIG. 1, there is shown a building structure of the present invention, a portion of which is broken away to illustrate the substructure. The substructure 10 includes vertical studs 12, which are typically wooden or light gauge steel.

Figure 2:
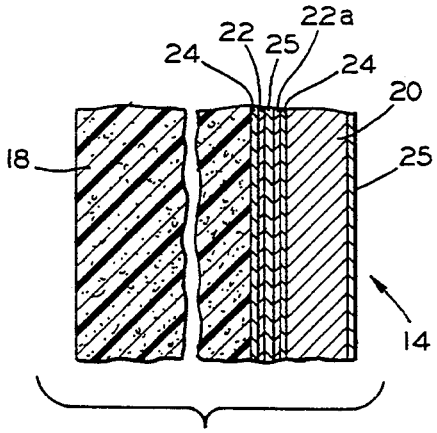
FIG. 2 is an enlarged sectional view of a laminated construction board of the present invention shown in FIG. 1.

FIG. 2 illustrates a laminated construction board 14 of the present invention. The construction board 14 includes a support backing 16, and a expanded foam insulating covering 18.

According to the present invention, a "kraft board" support backing 16 includes a fiberboard core 20. It should be understood that the term "kraft board" should be interpreted broadly to include virgin kraft board, recycled paper or "chip board," or a combination of these. On one side of the fiberboard core 20, a construction similar to that shown in the aforementioned U.S. Pat. No. 4,564,554 may be used, in which case a layer of adhesive 24 is used to secure a facing sheet 22. A layer of polymeric material, such as polyethylene 25 is sandwiched between the first facing sheet 22 and the second facing sheet 22*a*. On the other side of the fiberboard core 20 is a layer of polyethylene 25, which may be extruded during the manufacturing process.

While this is the construction used in the preferred embodiment, it should be understood that a fiberboard core 20 could be used without any facing sheets, or with facing on one or both sides, and be well within the scope of the present invention.

The support backing 16 may formed in various thicknesses depending on the strength and structural integrity required in the application in which the construction board 14 will be utilized. The support backing 16 will typically be of a thickness in the range of 0.050 inches to about 0.250 inches.

The foam covering 18 is preferably formed of an aerated, lightweight, multicellular polystyrene plastic, frequently referred to as an "expanded polystyrene insulation". However, many types of insulating materials may be used, such as extruded foams, glass foams, polyisocyanurate foams, urethane foams and the like. Also, it is contemplated that fiberglass insulating materials may be used. The foam covering 18 is typically formed as a separate panel which is then adhesively bonded to the support backing 16 with a layer of adhesive 24.

As will be hereinafter further discussed, the construction board 14 may be covered by a variety of surface treatments. FIG. 1 illustrates one preferred surface treatment consisting of a layer of a mesh material 28, embedded in a base coat 30, which in turn is covered by a layer of finish material 32. There may be multiple layers of the mesh 28 and base coat 30.

Referring now to FIGS. 3*a*, 3*b*, 3*c*, and 4, there are illustrated various methods which have hitherto been used to attach insulating panels, and in particular laminated construction boards, to the underlying substructure 10 over sheathing 15.

Figure 3A:
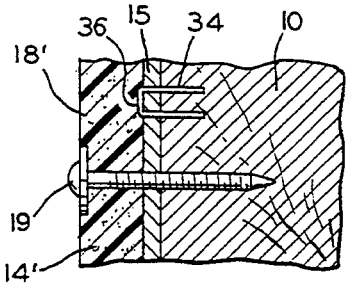
FIG. 3a (PRIOR ART)
FIG. 3*a* is a sectional view of a wall substructure sheathed with a prior art construction board. The construction board is shown screwed to a wooden substructure over an underlying substrate which has been stapled thereto.

FIG. 3*a* shows a sheathing 15 secured to the substructure 10 by a staple 34 having a crown 36. The construction board 14′ including the foam panel 18′, is fastened to the substructure 10 by a mechanical fastener 19. This conventional technique has not proven adequate because the foam panel 18′ may compress under the mechanical fastener 19 if the construction board 14′ is subject to a force which tends to pull it away from the substructure 10. Such a force may be experienced, for example, due to the effects of wind blowing around the building upon which the construction board 14′ is installed.

If the foam panel 18′ is compressed, any surface treatment, such as a layer of mortar (not shown), applied over the foam panel 18' would be unevenly supported, and may result in nail pops. Additionally, the mechanical fastener 19 is in contact with the surface treatment, which may lead to rust-through.

Figure 3B:
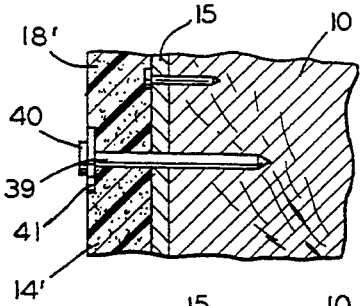
FIG. 3b (PRIOR ART)
FIG. 3*b* is a view similar in part to FIG. 3*a*, showing the construction board and the substrate nailed to the wooden substructure.

FIG. 3*b* is similar to FIG. 3*a*, except that a nail is shown holding the sheathing 15 to the substructure 10. Large nail 39 having head 40 and washer 41 holds the construction board 14' to the substructure 10. It will be appreciated that this method of fastening may result in the same types of damage that is experienced in the conventional technique discussed above.

Figure 3C:
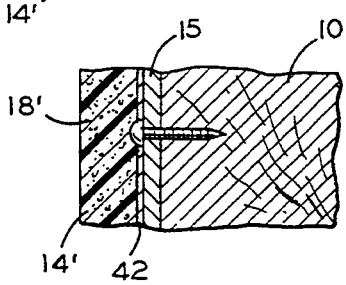
FIG. 3c (PRIOR ART)
FIG. 3*c* is a view similar in part to FIGS. 3*a* and 3*b*, showing the construction board adhesively bonded to a substrate which has been screwed to the underlying wall substructure.

FIG. 3*c* is similar to FIGS. 3*a* and 3*b*, except that the construction board 14' is adhesively secured to the sheathing 15 by a layer of cement 42 after the sheathing is screwed to the substructure 10. While avoiding the problems of nail popping and rust stains, the use of cement has certain other undesirable drawbacks. The cement may only be applied within a certain range of temperatures, and adequate time must be allowed to let the cement layer dry.

There is also known a construction method where a polymer foam is supplied without a backing and nailed directly to the substructure 10. This method produces a very weak construction and is not preferred. It should also be understood that only the most common types of prior art systems have been described and there are many types of prior art mechanical fasteners which have been used to secure foam panels to underlying substructures; however, all of these fasteners present problems similar to the those discussed above.

Figure 4:
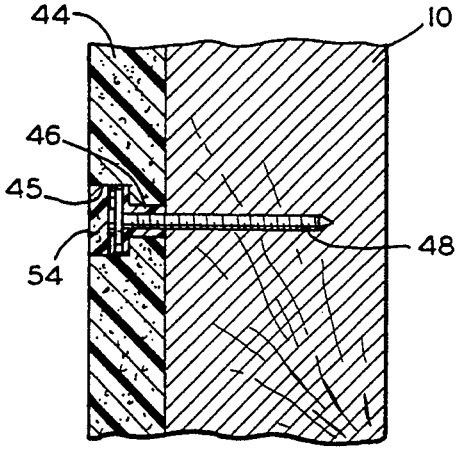
FIG. 4 (PRIOR ART)
FIG. 4 is a sectional view of a wall sheathed with a construction board utilizing a prior art method. A fastening member engages an inner layer of the board, and a plug is inserted in an outer layer to cover the head of the fastening member.

Illustrated in FIG. 4 is another system of attaching a composite board to an underlying substructure 10. The board has a panel 44 having a plurality of stepped openings 45 into which is inserted a plurality of flanged hollow sleeves 46. A mechanical fastener 48 is inserted through the sleeves to engage the substructure 10. The fastener 48 secures the sleeve 46 to the substructure 10, and the flange of the sleeve in turn engages the panel 44.

A plug 54 is inserted in each opening 52 after each fastener 48 has been fastened to the substructure 10. The plug 54 levels the outer surface of the outer panel 50, helps avoid nail popping by providing more even support to the surface finish, and acts as a barrier to leaching of rust through the surface layer.

While avoiding the problems of the use of cement, installing the plugs 54 is an extra installation step which adds to the expense and time required to install the board. Further, the panel may only be fastened when a sleeve 46 is adjacent an appropriate portion of the substructure 10. If, for example, the underlying substructure 10 includes studs 12 which are not regularly spaced, the sleeve 46 may be located over a void between studs, and thus the board may not be able to be fastened in that location.

FIGS. 5–8, and 13 illustrate a method of attachment of the present invention which overcomes the problems previously experienced in the art. The construction board 14 is held in abutting relationship with the underlying substructure 10 by a plurality of staples 56. If light gauge steel studs are used, the construction board 14 would be screwed to the studs. However, since wood studs are much more common, for purposes of illustration, the invention as used with wood studs will be described.

Each staple 56 has a crown 58 joining a pair of outwardly extending parallel legs 60, each leg ending in a point 62. The crown 58 intimately engages the support backing 16, and the legs 60 extend through the support backing 16 and are anchored in the underlying substructure 10.

A stapler 64 is pneumatically driven by air supplied through hose 66 from a compressed air supply (not shown). The stapler 64 includes a pneumatic motor 68, a driving hammer 70, an aligning member 72, an actuating trigger 74, and a staple magazine 76 including a first end 77. In order to attach the construction board 14 to the underlying substructure 10, the operator actuates the trigger 74, which causes compressed air to be admitted into the pneumatic motor 68, which urges the driving hammer 70 to rapidly extend outwardly. The driving hammer 70 engages a staple 56 positioned at the first end of the magazine 77 and drives it into aligning member 72, and thence into the construction board 14. The magazine 76 of the staple gun 64 holds a plurality of staples 56, which are urged sequentially toward the first end 77 by a spring (not shown), where they may be driven from the stapler 64.

Figure 8:
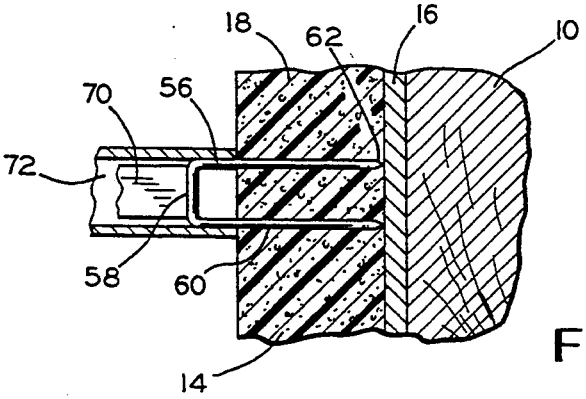
FIG. 8 is a partial sectional view, taken in the direction of the arrows, along the section line 8—8 of FIG. 7, illustrating a staple being driven into the board, and engaging the support backing before being released from the alignment means.

As best seen in FIG. 8, the staple 56 preferably engages the support backing 16 while the staple 56 is still retained within the aligning member 72. The longer than normal driving hammer 70 may actually follow the staple 56 out of the alignment member 72, and follow it all or a substantial part of the distance to, the support backing 16. Stapling guns, such as those made by Senco Products, Inc., of Cincinnati, Ohio come in various sizes, and the longer than normal driving hammer required may be supplied simply by taking a longer driving hammer from one of the larger stapling guns, and substituting it in a smaller stapling gun. However, any method of modification of any stapling gun which provides a driving hammer which will follow the staple out of the stapling gun for a substantial distance will enable the method of the present invention to be performed. The staple 56 receives alignment from the support backing 16 and the underlying substructure 10 as these are penetrated and the staple 56 is expelled from the aligning member 72.

The legs 60 of the staples 56 may suitably be formed with a plurality of barbs or circumferential ribs (not shown) in order to increase their holding power. This is appropriate when the substructure 10 includes light gauge steel studs 12, or when it is desired to give the staple extra resistance to being removed from the substructure 10.

Figure 5:
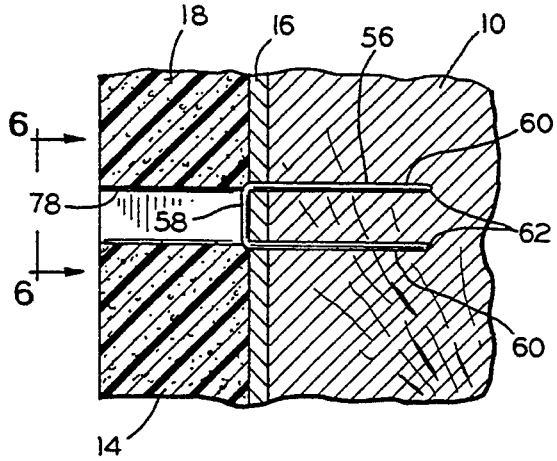
FIG. 5 is a sectional view, taken in the direction of the arrows, along the section line 5—5 of FIG. 1, showing the crown of a staple engaging the support backing of the construction board and the underlying wall substructure.
Figure 6:
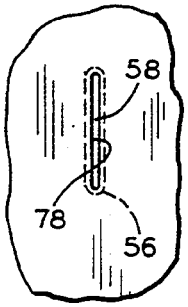
FIG. 6 is a plan view of the construction board and staple of FIG. 5 as seen generally along the view line 6—6 of FIG. 5.
Figure 7:
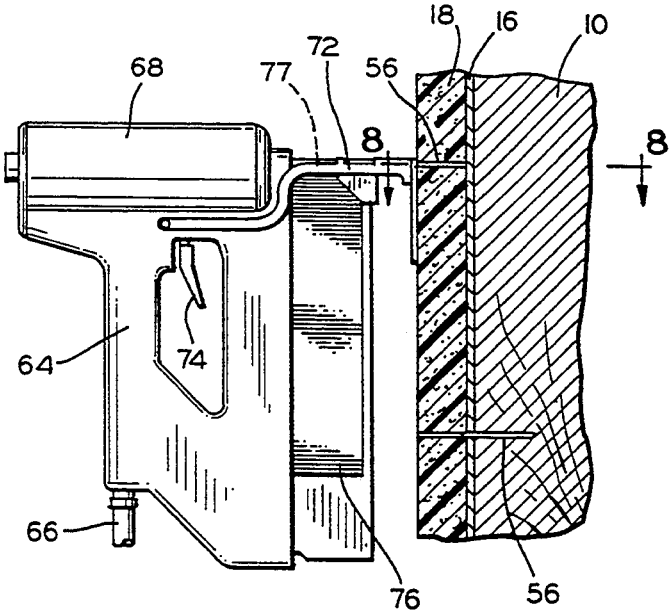
FIG. 7 is a view similar in part to FIG. 5 showing a pneumatic staple gun utilized to drive the securing staples, a fully inserted staple, and a staple in the process of being driven into the construction board.

As best seen in FIGS. 4 and 5, the process of the driving a staple 56 through the foam covering 18 results in the formation of a opening 78 in the foam covering 18. In the preferred embodiment, the foam covering 18 is flexible and has "memory," therefore the foam 18 substantially closes in upon itself following passage of the staple 56.

This results in a greater ease in applying certain surface finishes, because virtually no filling of the opening 78 is required. The surface finish is thus of a relatively uniform thickness, and dries evenly, with no cracking or dimpling which might result if portions of the surface finishing material were significantly thicker and slower drying than others. No special plug need be inserted in the opening 78 to level the surface or cover the crown of the staple.

Figure 14:
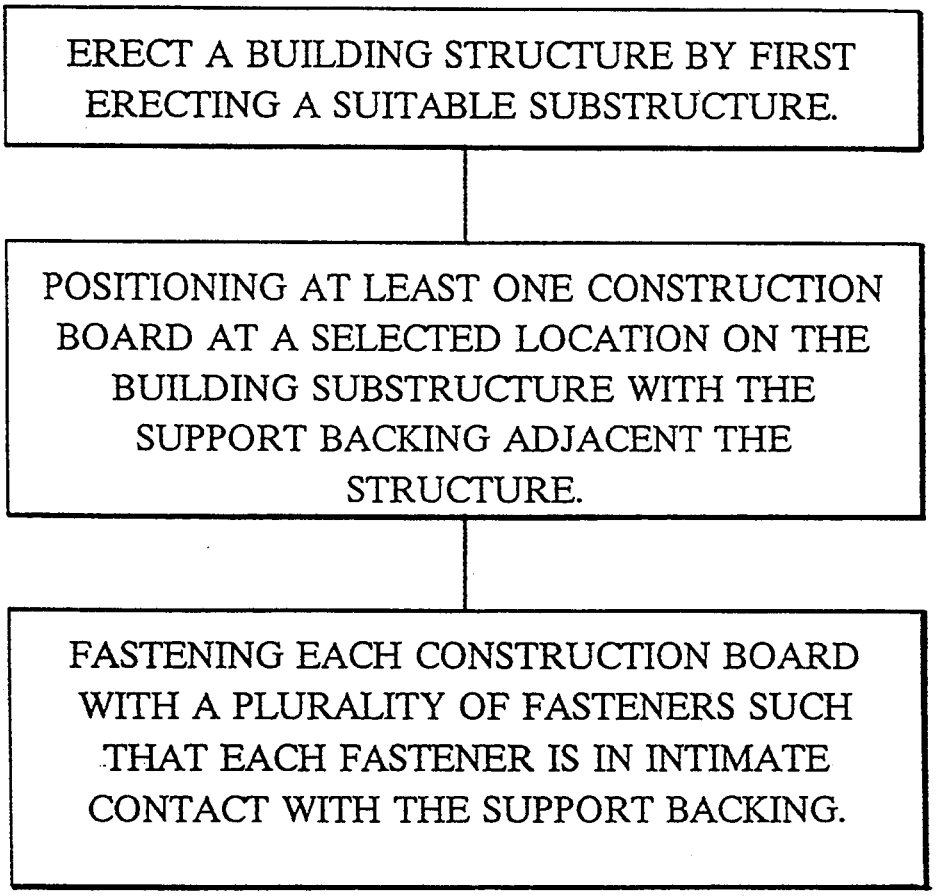
FIG. 14 is a flow chart illustrating a method of constructing a building structure according to the present invention.
Figure 15:
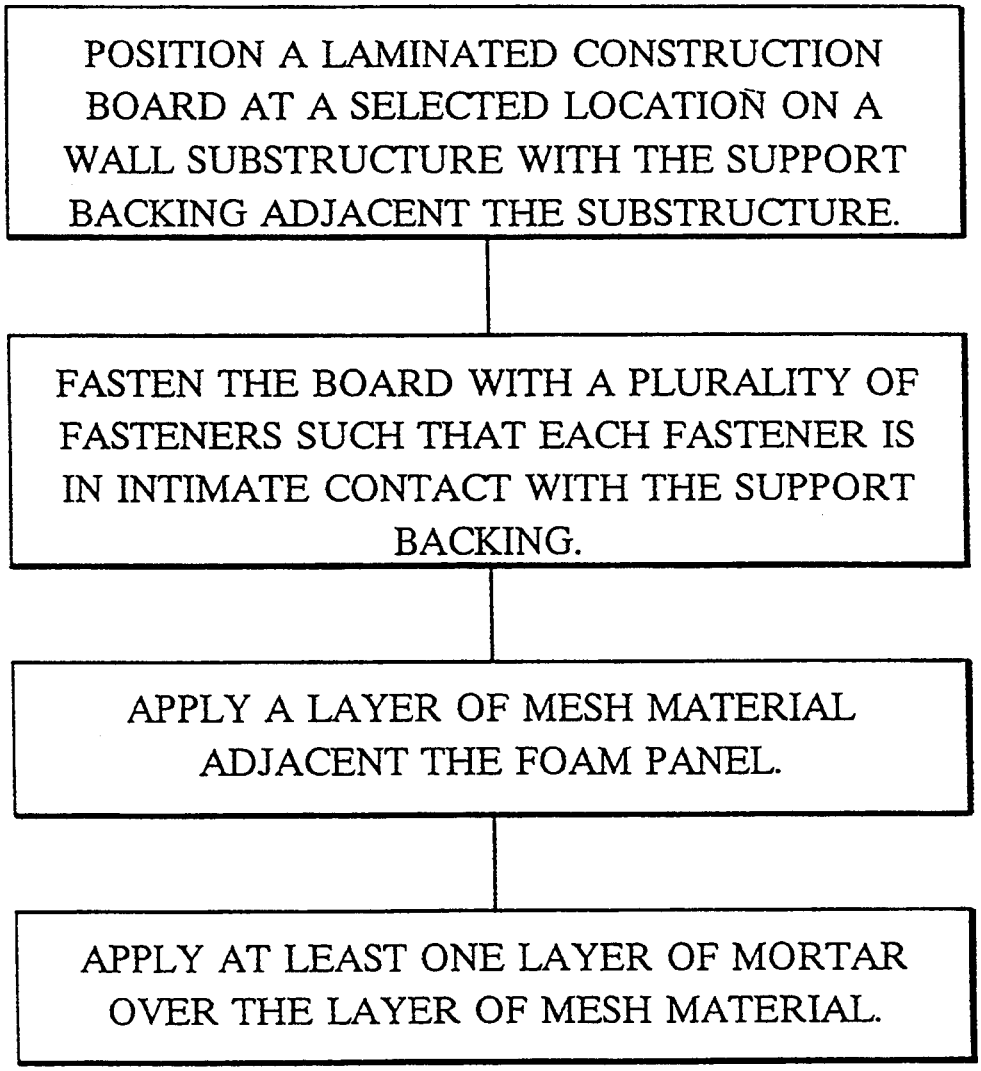
FIG. 15 is a flow chart of a method according to the present invention of constructing a wall sheathing.

As illustrated in FIGS. 1 and 14, in constructing a composite building structure of the present invention there is first erected an underlying substructure 10. The substructure 10 may include steel or wooden studs 12, and may further include a sheathing layer (not shown) attached over the studs 12. The construction board 14 is placed in a desired location on the external surface of the substructure 10.

The construction board 14 may be one including a kraft board support backing as hereinabove disclosed, or may be the composite construction board of my U.S. Pat. No. 4,564,554, or other suitable laminated construction board having a foam covering.

The construction board 14 is placed at a selected location on the wall substructure 10, with the support backing 16 abutting the substructure 10 utilizing a staple gun 64 or other suitable means, the operator drives a plurality of staples 56 into the construction board 14 and into the substructure 10, such that the crown 58 of the staple is in intimate contact with the support backing 16, holding it securely against the underlying substructure 10. The driving hammer 70 of the staple gun 64 may extend into the foam covering 18 as it is driving the staple 56 into the construction board 14, until the crown 58 engages the support backing 16. The operator may then move the staple gun 64 to another desired attachment point, and simply pull the trigger 74 to drive another staple 56 into the construction board 14. Thus the construction board 14 may be quickly and securely attached to the substructure 10, with attachment points determined according to the layout of the underlying substructure 10.

In order to meet building code requirements, the composite structure may be required to be constructed with sufficient structural strength and integrity to achieve a designated structural rating. This has typically been accomplished in the past in part through the use of crossbracing or through the use of wooden sheathing over the substructure 10.

It is anticipated that the construction board 14 of the present invention may be manufactured from a variety of materials and in a variety of thicknesses, both of the support backing 16 and the foam covering 18, dependent upon the desired application. The kraft board support backing 16 may be manufactured in a thickness which will give the construction board 14 sufficient rigidity and strength so that when fastened by staples whose crowns 58 are in intimate contact with the support backing 16, a desired structural rating may be obtained. In such an instance, no sheathing layer would be required over the substructure 10, thereby resulting in considerable cost savings. The construction boards 14 may be fixed directly to the studs 12 by the staples 56 in the manner described above.

Whether the improved construction board of the invention is used on new construction or for residing or restoring old construction, suitable surface finish may be utilized to cover the construction board 14. Surface finish treatments considered suitable include a stucco or mortar finish, synthetic stucco, or thin set brick bedded in a mortar compound. Additionally, treatments which do not require coating the underlying construction board, such as metal, wood, or plastic siding, or brick may also be utilized.

In a preferred embodiment, the surface treatment of the composite structure of the present invention will have an acrylic mortar base. One such treatment is the "FINESTONE" wall surfacing system, which is available from Simplex Products Division, Adrian, Mich., U.S.A.

Figure 9:
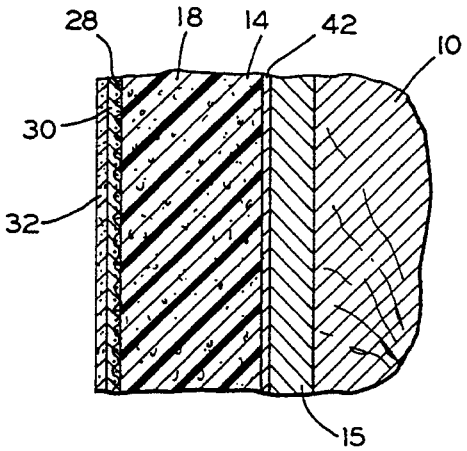
FIG. 9 (PRIOR ART)
FIG. 9 is a view similar in part to FIG. 3*c*, showing the construction board adhesively secured to a substrate and covered with a surface finishing system.
Figure 10:
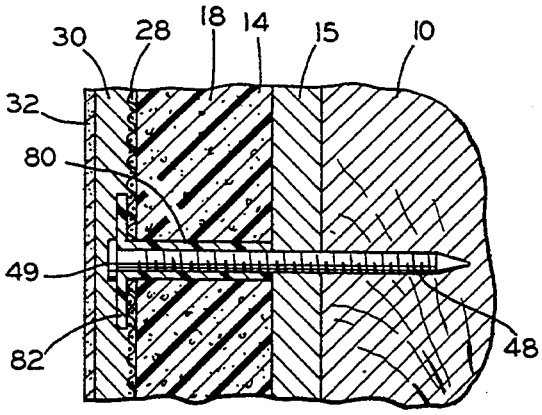
FIG. 10 (PRIOR ART)
FIG. 10 is a view similar in part to FIG. 9, showing a mechanical fastening member used to secure the construction board.

Referring to FIGS. 9 and 10, there are shown two wall sections in which the FINESTONE wall surfacing system has been applied to a construction board 14' attached to a substructure 10 over sheathing 15 by methods known in the prior art. FIG. 9 illustrates the construction board 14' adhesively bonded to the sheathing 15 by a layer of cement 42. A layer of mesh material 28 is applied over the outer foam covering 18' and acrylic based mortar 30 is applied over the mesh material 28 in a thin layer whereby after the mortar 30 dries it tightly adheres to the mesh material 28 and the underlying foam covering 18'. A layer of finish material 32 is applied over the layer of mortar 30.

Mechanical fasteners have been used to secure the construction board 14' to the substructure 10 over sheathing 15. This is illustrated in FIG. 10. In the method previously known, a construction board 14' is positioned at a desired location on the substructure 10. A layer of mesh material 28 is placed over the construction board 14', and a plurality of flanged hollow sleeves 80 are inserted through the mash material 28 and the foam covering 18'. A mechanical fastener 48 is driven through the hollow sleeve 80 and anchored in the underlying substructure 10. The mechanical fastener 48 has a flanged head 49 which retains the hollow sleeve 46. The hollow sleeve 80 is provided with a flange 82, which retains the mesh material 28 and the construction board 14' securely in place.

A layer of acrylic mortar 30 is applied evenly over the mesh material 28, the flanged hollow sleeve 46, and the fastener head 49. The layer of mortar 30 must be relatively thicker than that which is applied when the construction board 14' is secured by cement, because the fastener head 49 and sleeve flange 82 project outwardly from the surface of the construction board 14'. A layer of finish material 32 is subsequently applied over the mortar 30.

It is obviously time consuming to insert the hollow sleeve and then engage the mechanical fastener. The method of attaching the construction board 14 of the present invention has the advantages of speed, ease of use, and the positive engagement of a mechanical fastener, without the problems of "nail pops" or "rust through."

In the preferred embodiment, the composite structure of the present invention will be covered with a wall surfacing system such as the FINESTONE system, as illustrated in FIGS. 1, 11, 12, and 15. After positioning the construction board 14 directly over the substructure 10 of a wall, the construction board 14 is fastened to the substructure 10 with a plurality of staples 56, the crown of each staple 56 being in intimate contact with the support backing 16. A layer of mesh material 28 is positioned over the foam covering 18, and a layer of acrylic mortar 30 is applied. As hereinbefore described, during installation, the foam covering 18 flexibly substantially closes in upon itself following passage of the staple 56 as the staple is driven through the foam covering 18.

Figure 11:
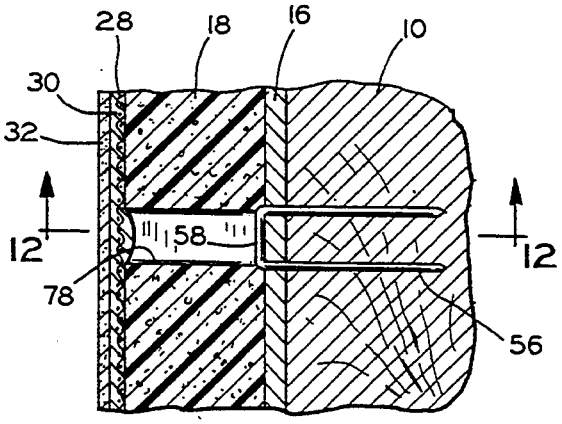
FIG. 11 is a view similar in part to FIG. 5, showing the construction board of the present invention directly attached to a wooden substructure, and covered with a surface finishing system.
Figure 12:
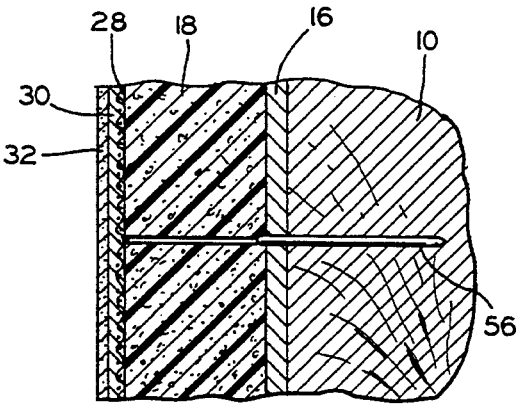
FIG. 12 is a sectional view, taken in the direction of the arrows, along the section line 12—12 of FIG. 11.
Figure 13:
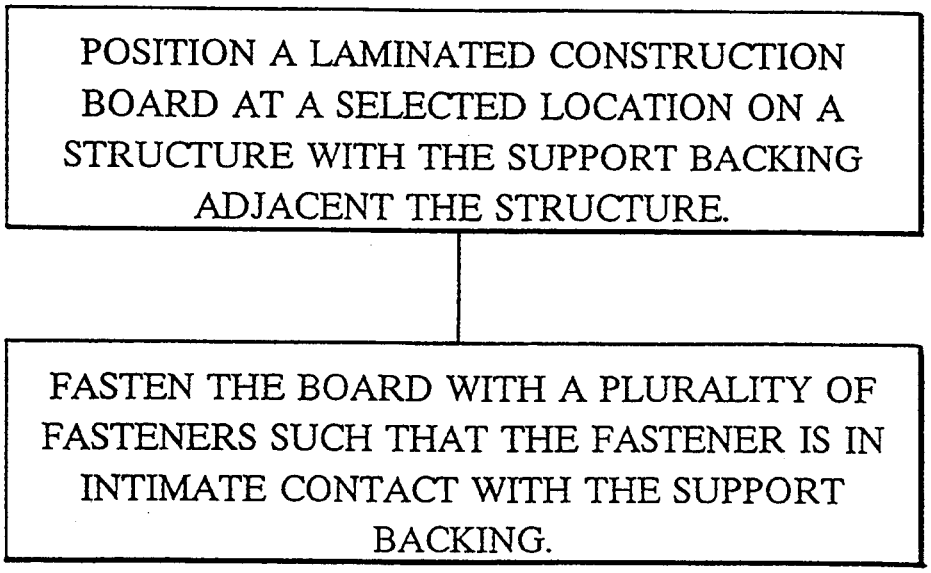
FIG. 13 is a flow chart illustrating a method of the present invention for installing a laminated construction board.

As shown in FIGS. 11 and 12, very little of the acrylic mortar 30 penetrates into the thus constricted opening 78. No specific step to fill in the opening 78 is required. A thin, even layer of mortar 30 may be applied over the foam covering 18 and mesh material 28. The mortar layer 30 according to the present invention may be considerably thinner than was able to be achieved in prior art where mechanical fasteners were utilized because the crown 58 is recessed in the foam covering 18. This results in considerable cost savings from the use of less materials.

A layer of finish material 32 is applied over the thin layer of mortar 30. The finish material 32 is preferably an acrylic polymer material such as that utilized in the FINESTONE system. Acrylic polymer formulations have been found to be more durable and less crack prone than a conventional stucco finish. The finish material 32 is suitably colored and textured in order to achieve the desired appearance.

It should be realized that in certain instances it may be desirable to apply more than one layer of mortar over the foam covering, or more than one layer of mesh material. For example, it is known that in applications where a higher degree of impact resistance is desired, there is supplied a first layer of mesh material over the foam covering, a layer of mortar over the first layer of mesh adhering to the mesh and the foam covering, a second layer of mesh material placed over the first layer of mortar, and an additional layer of mortar applied over the second layer of mesh material and the first layer of mortar, tightly adhering to each upon drying (not shown). A layer of finished material would be applied over the second layer of mortar.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A wall surfacing system adapted to cover a wall substructure, said wall surfacing system comprising:

a) a support backing provided with an outer surface, and with an inner surface for engaging an outer edge of a wall substructure;

b) an elastic foam panel adhesively secured to the outer surface of said support backing;

c) staple means for securing said support backing and said elastic foam panel to the wall substructure, said staple means including a staple gun and a plurality of thin staples such that the staple gun drives a staple through said elastic foam panel to create a slit in said elastic foam panel, each staple having a crown engaging the outer surface of said support backing and a pair of legs extending through said support backing into the wall structure, whereby the slit in said elastic foam panel is substantially closed after the staple is driven through said elastic foam panel;

d) a layer of mesh material positioned on an outer surface of said elastic foam panel; and e) a layer of mortar applied over said layer of mesh material to form an outer surface, said layer of mortar securably engaging said layer of mesh material to said elastic foam panel.

2. The structure of claim 1 wherein said support backing comprises a kraft board.

3. The structure of claim 2, wherein said kraft board comprises a fiberboard core adhesively secured between facing sheets, each of said facing sheets formed from at least one layer of kraft paper.

4. The structure of claim 2, wherein said kraft board comprises a fiberboard core having a polyethylene layer on one side and an adhesively secured facing sheet on the other side.

5. The structure defined in claim 4, wherein said adhesively secured facing sheet comprises a layer of polyethylene sandwiched between two layers of kraft paper.

6. The structure of claim 2, wherein said kraft board backing has a thickness from about 0.050 inches to about 0.250 inches.

7. The wall surfacing system of claim 1, wherein said foam panel is formed by expanded polystyrene insulation.

8. The structure of claim 1, wherein said foam panel is adhesively bonded to said support backing.

9. The structure of claim 1, wherein said layer of mortar is formed from an acrylic resin.

10. The invention defined in claim 1, including a layer of finish material on the outer surface of said layer of mortar.

11. The invention defined in claim 10 wherein said finish material includes an acrylic resin.

* * * * *